US005291864A

United States Patent [19]

Suga et al.

[11] Patent Number: 5,291,864

[45] Date of Patent: Mar. 8, 1994

[54] SYSTEM FOR DRIVING ENGINE ACCESSORIES OF INTERNAL COMBUSTION ENGINE

[75] Inventors: Takashi Suga, Yokosuka; Shigeru Kamegaya, Tokyo, both of Japan

[73] Assignee: Nissan Motor Co., Ltd., Yokohama, Japan

[21] Appl. No.: 77,439

[22] Filed: Jun. 17, 1993

[30] Foreign Application Priority Data

Jun. 29, 1992 [JP] Japan ..... 4-170299
Jun. 29, 1992 [JP] Japan ..... 4-170301
Mar. 3, 1993 [JP] Japan ..... 5-041580

[51] Int. Cl.[5] ..... F02B 77/00
[52] U.S. Cl. ..... 123/198 R; 123/198 C
[58] Field of Search ..... 123/198 R, 198 C, 196 R, 123/195 A

[56] References Cited

FOREIGN PATENT DOCUMENTS 63-79432 5/1988 Japan .
2-175336 7/1990 Japan .

*Primary Examiner*—Noah P. Kamen
*Attorney, Agent, or Firm*—Foley & Lardner

[57] ABSTRACT

A hydraulic pump is mounted to a cylinder block of an internal combustion engine and powered by said engine, and a hydraulic motor for operating an engine accessory, such as alternator, compressor of air conditioner and the like, is mounted to the cylinder block and driven by a highly pressurized oil fed by the hydraulic pump. The cylinder block is formed with an oil flow passage through which the highly pressurized oil is conveyed from the hydraulic pump to the hydraulic motor. An oil return passage is provided for returning the oil from the hydraulic motor to the hydraulic pump. If desired, the oil return passage may be defined in the cylinder block.

16 Claims, 17 Drawing Sheets

SYSTEM FOR DRIVING ENGINE ACCESSORIES OF INTERNAL COMBUSTION ENGINE

BACKGROUND OF THE INVENTION

1. Field of the Invention

The present invention relates in general to systems for driving engine accessories, such as alternator, compressor of air conditioner and the like, of an automotive internal combustion engine, and more particularly to the engine accessory driving systems of a type which includes a hydraulic pump powered by the engine and a hydraulic motor powered by the hydraulic pump for driving the engine accessories.

2. Description of the Prior Art

As is known, automotive engine accessories, such as alternator, compressor of air conditioner, and the like are usually powered by the internal combustion engine mounted on the vehicle. In some of the motor vehicles, the power transmission from the engine to the engine accessories is carried out by using transmission belts each being directly driven by a crankshaft of the engine. However, this type power transmission sometimes brings about a power lack of each engine accessory particularly when the engine is under idling operation.

In order to solve this drawback, a driving system has been proposed by, for example, Japanese Utility Model First Provisional Publication 63-79432 and Japanese Patent First Provisional Publication 2-175336, in which a hydraulic motor driven by a hydraulic pump powered by the engine is used for driving the engine accessory. That is, the hydraulic pump is driven by the crankshaft of the engine through a transmission belt, and a pressurized oil produced by the hydraulic pump is fed through a separate high pressure pipe to the hydraulic motor to operate the same.

However, due to its inherent construction, even this driving system has such a drawback that under operation of the engine, the high pressure pipe tends to vibrate due to inevitable pulsation of the highly pressurized oil discharged from the hydraulic pump, which causes increase in noise level of the engine. Furthermore, the high pressure prevailing in the pipe causes a complicated and thus expensive construction of seal at both ends of the pipe. Furthermore, assembly of the pipe around the engine is troublesome.

SUMMARY OF THE INVENTION

It is therefore an object of the present invention to provide a system for driving engine accessories of internal combustion engine, which system is free of the above-mentioned drawbacks.

According to a first aspect of the present invention, there is provided an engine accessory driving system for use with an internal combustion engine having a cylinder block. The system comprises a hydraulic pump mounted to the cylinder block and powered by the engine; a hydraulic motor mounted to the cylinder block and driven by a highly pressurized oil fed by the hydraulic pump; means defining in the cylinder block an oil flow passage through which the highly pressurized oil is conveyed from the hydraulic pump to the hydraulic motor; and oil returning means for returning the oil from the hydraulic motor to the hydraulic pump.

According to a second aspect of the present invention, there is provided an engine accessory driving system for use with an internal combustion engine having a V-type cylinder block. The system comprises a hydraulic pump mounted on a bottom of a V-shaped recess which is defined by and between the two banks of the V-type cylinder block, the hydraulic pump being powered by the engine; first and second hydraulic motors respectively mounted to the two banks of the cylinder block, each hydraulic motor being driven by a highly pressurized oil fed by the hydraulic pump; means for defining in the cylinder block respective oil flow passages through which the highly pressurized oil is conveyed from the hydraulic pump to the first and second hydraulic pumps independently; and oil returning means for conveying the oil from the first and second hydraulic motors to the hydraulic pump.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Referring to FIGS. 1 to 5 of the drawings, there is shown a driving system of a first embodiment of the present invention. The following description is directed to the invention practically applied to a V-8 internal combustion engine.

Figure 1:
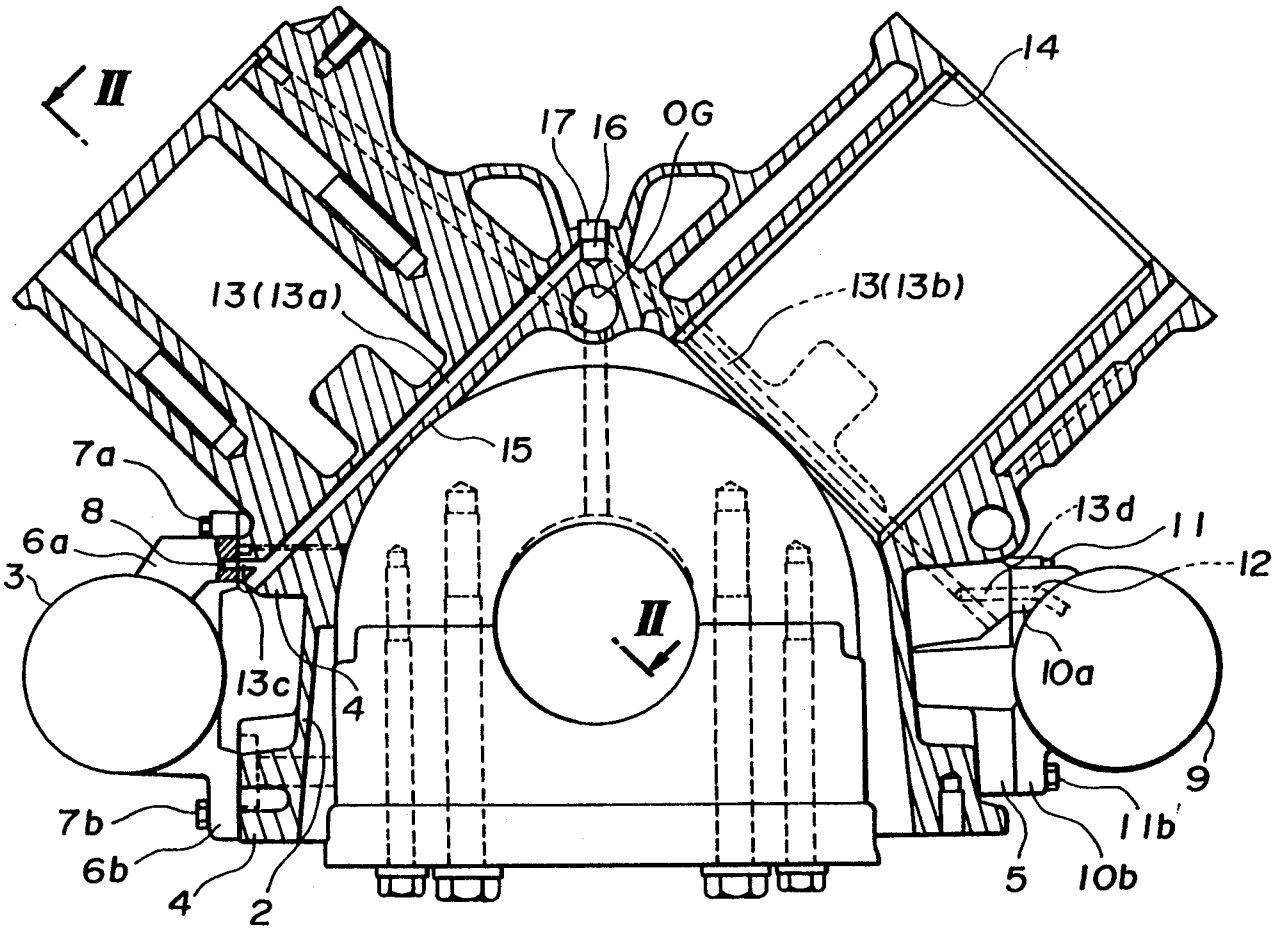
FIG. 1 is a sectional view of a cylinder block of a V-8 internal combustion engine which is a first embodiment of the present invention.
Figure 2:
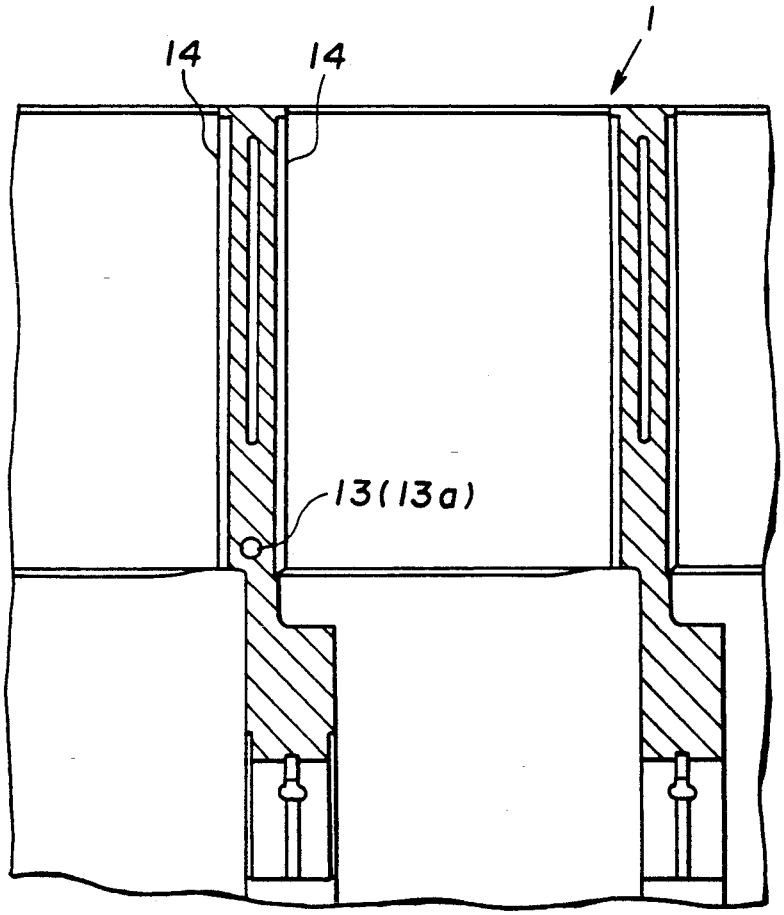
FIG. 2 is a sectional view taken along the line II—II of FIG. 1.

In FIG. 1, there is shown a cylinder block of the V-8 engine, which is generally designated by numeral 1. Designated by reference "OG" is an oil gallery formed in the cylinder head 1, which constitutes the lubrication system of the engine. One side portion of the cylinder block 1, which forms one skirt part 2 of the same, is formed with a mounting portion 4 on which a hydraulic pump 3 is tightly mounted, while, the other side portion of the cylinder block 1, which forms the other skirt part 2 of the same, is formed with another mounting portion 5 on which a hydraulic motor 9 is tightly mounted.

The hydraulic pump 3 may be of a radial type. The pump 3 has upper and lower mounting flanges 6*a* and 6*b* secured through bolts 7*a* and 7*b* to the mounting portion 4. The upper mounting flange 6*a* has a through passage 8 which extends from a discharge port of the hydraulic pump 3. As is seen from FIG. 4, the mounting flange 6*a* is formed with a flat mating surface 6*a'* to which the through passage 8 is exposed.

Although not shown in the drawings, the hydraulic motor 9 has a drive shaft by which the engine accessories, such as alternator, compressor of air conditioner and the like, are driven or powered. In fact, the drive shaft constitutes a common drive shaft of the engine accessories.

As is seen from FIG. 1, the hydraulic motor 9 has upper and lower mounting flanges 10*a* and 10*b* secured through bolts 11*a* and 11*b* to the mounting portion 5 of the cylinder block 1. The upper mounting flange 10*a* has a through passage 12 which leads to an inlet port of the hydraulic motor 9. Similar to the case of the hydraulic pump 3, the mounting flange 10*a* is formed with a flat mating surface to which the through passage 12 is exposed.

As is seen from FIG. 1, an oil flow passage 13 is formed in the cylinder block 1 to connect the outlet passage 8 of the hydraulic pump 3 with the inlet passage 12 of the hydraulic motor 9. That is, the passage 13 comprises two elongate bores 13*a* and 13*b* which extend straight in respective banks of the V-shaped cylinder block 1. Each elongate bore 13*a* or 13*b* extends in a lower deck between two adjacent cylinder bores 14 of the corresponding bank.

Figure 3:
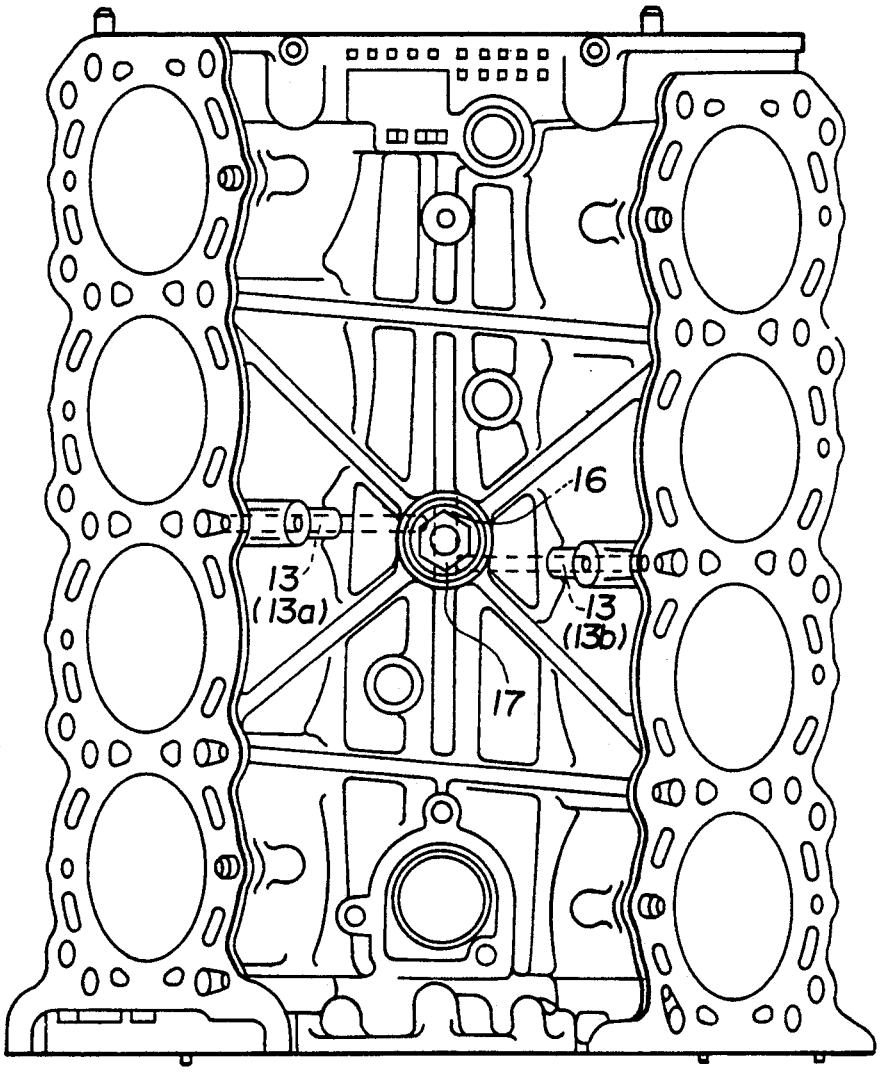
FIG. 3 is a plan view of the cylinder block.

As is seen from FIG. 3, the bores 13*a* and 13*b* are somewhat offset from each other and thus a short bore 16 is formed in an upper portion of the conjunction part between the two banks to connect the two bores 13*a* and 13*b*.

As is seen from FIG. 1, the short bore 16 has an opening which is closed by a sealing plug 17. Although not well shown in the drawing, each elongate bore 13*a* or 13*b* has a terminal lower open end which is closed by a sealing plug. Furthermore, each elongate bore 13*a* or 13*b* has near the closed terminal lower end a branch bore 13*c* or 13*d* which is mated or connected with the passage 8 or 12.

Figure 4:
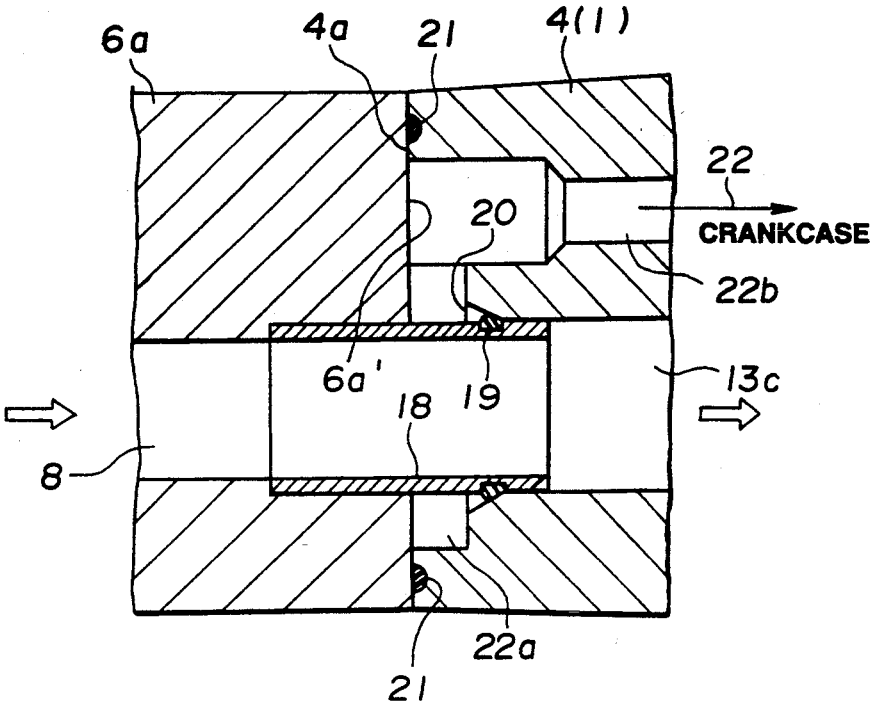
FIG. 4 is an enlarged sectional view of the portion where a hydraulic pump is mounted the cylinder block.

FIG. 4 shows in detail the manner for sealingly connecting the branch bore 13*c* of the elongate bore 13*a* with the outlet passage 8 of the hydraulic pump 3. A coupling sleeve 18 is press-fitted but halfly in the passage 8. A first seal ring 19 is put in an annular groove formed around the exposed part of the sleeve 18. The branch bore 13*c*, has a tapered end 20 which, upon assembly, presses the first seal ring 19 to achieve a sealed connection between the two passages 8 and 13*c*. As shown, a second seal ring 21 is disposed between the mating surface 6*a'* of the mounting flange 6*a* of the hydraulic pump 3 and the mating surface 4*a* of the mounting portion 4 of the cylinder block 1. Thus, the connection between the branch bore 13*c* and the outlet passage 8 is assured with a so-called "double sealing". As is understood from the same drawing, a leak passage 22 is formed in the mounting portion 4 of the cylinder block 1, which comprises an annular space 22*a* surrounding the coupling sleeve 18 and an elongate bore 22*b* extending to the interior of a crankcase of the engine.

It is to be noted that the sealing connection between the branch bore 13*d* of the elongate bore 13*b* and the inlet passage 12 of the hydraulic motor 9 is substantially the same as the above-mentioned connection between the branch bore 13*c* and the outlet passage 8.

Figure 5:
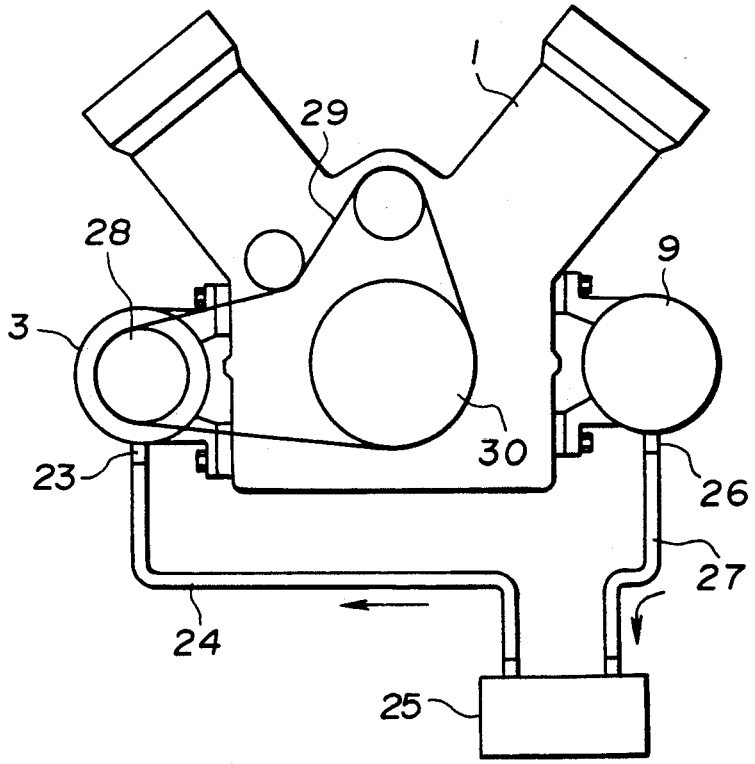
FIG. 5 is a schematic illustration of an engine accessory driving system.

FIG. 5 shows schematically the entire of the engine accessory driving system of the first embodiment. A drive shaft of the hydraulic pump 3 has a pulley 28 which is driven through a transmission belt 29 by another pulley 30 fixed to a crankshaft of the engine. An inlet port 23 of the hydraulic pump 3 is connected through an inlet tube 24 to an oil tank 25 which is mounted on the vehicle. An outlet port 26 of the hydraulic motor 9 is connected through a return tube 27 to the oil tank 25.

It is to be noted that the hydraulic part of this engine accessory driving system is isolated from a lubrication system of the engine.

It is further to be noted that since the pressure prevailing in the tubes 24 and 27 is relatively low, these pipes 24 and 27 are prevented from suffering marked vibration and oil leakage.

When, in operation, the engine runs, the hydraulic pump 3 is driven by the engine and thus the hydraulic pump 3 feeds the hydraulic motor 9 with a highly pressurized oil to operate the same. Thus, the engine accessories powered by the hydraulic motor 9 can work powerfully.

In the following, advantages of the above-mentioned first embodiment invention will be described.

First, as is described hereinabove, the means for conveying the highly pressurized oil from the hydraulic pump 3 to the hydraulic motor 9 is the oil flow passage 13 formed in the cylinder block 1 which is strongly built. That is, there is no need of using a separate pipe for flowing such highly pressurized oil. Thus, the noise trouble, oil leakage and troublesome assembly, which have been encountered in the above-mentioned conventional driving system, are eliminated or at least minimized in the present invention.

Second, as is seen from FIG. 4, due to the double sealing structure constituted by the first and second seal rings 19 and 21, leakage of the pressurized oil from the oil flow passage 13 is assuredly suppressed. That is, even if the pressurized oil leaks through the first seal ring 19, the second seal ring 21 backs up. The oil thus leaked is led into the crankcase through the leak passage 22.

Third, when the hydraulic pump 3 is of a radial type as in the case of the invention, a constant discharge is expected at a speed higher than a given level. This means that the accessories can be operated at a constant level irrespective of the engine speed.

Figure 6:
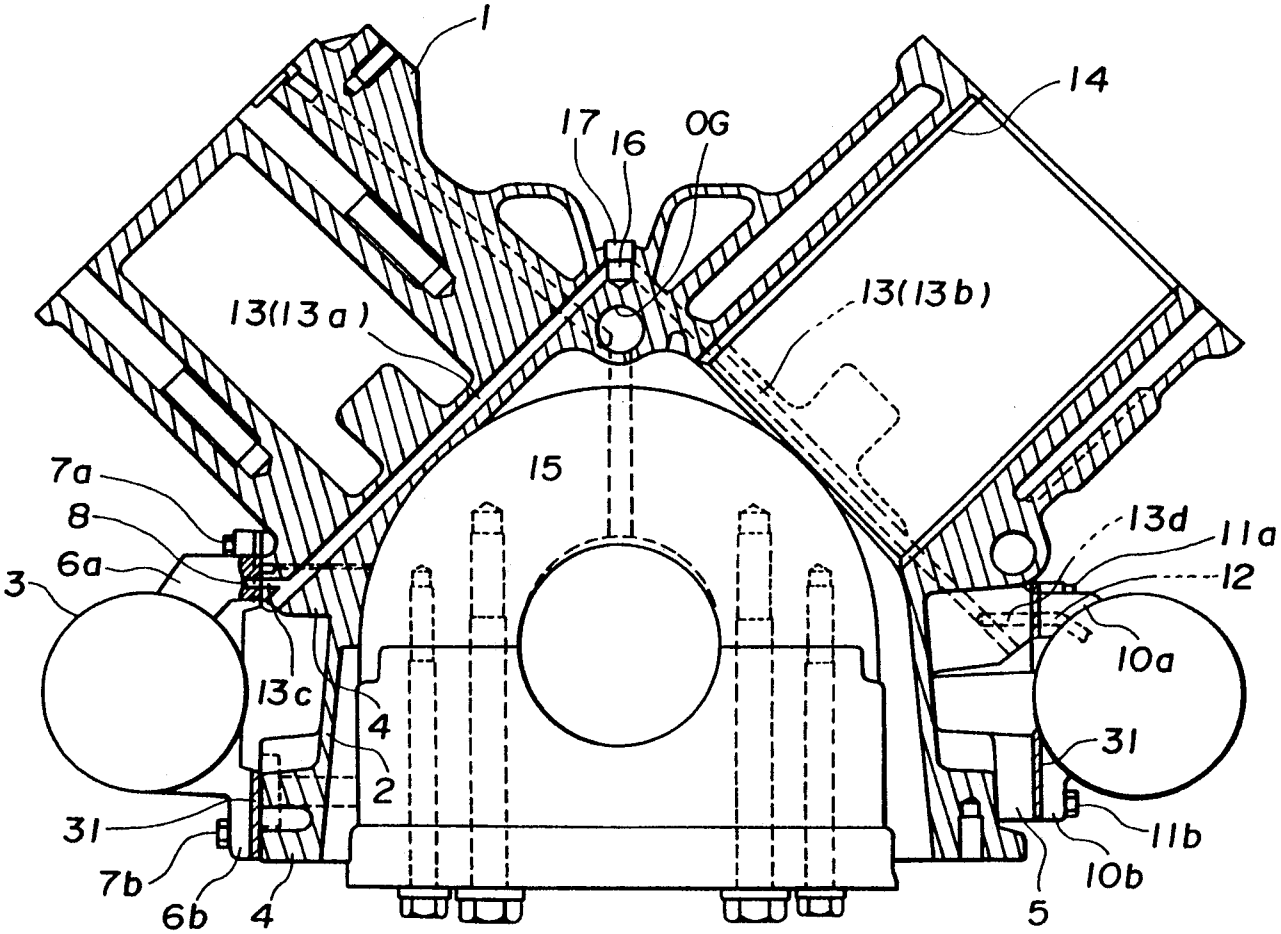
FIG. 6 is a view similar to FIG. 1, but showing a second embodiment of the present invention.
Figure 7:
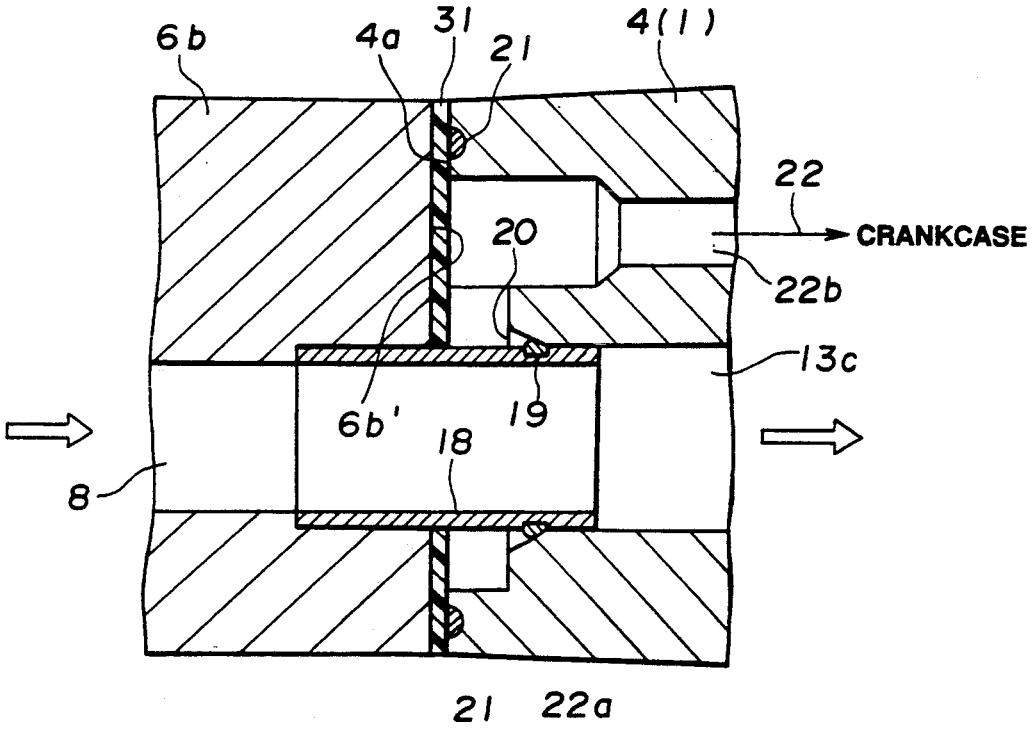
FIG. 7 is a view similar to FIG. 4, but showing the case of the second embodiment.

Referring to FIGS. 6 and 7, there is shown a second embodiment of the present invention.

As is best seen from FIG. 7, in this second embodiment, a shock absorbing sheet 31 is disposed between the mounting portion 4 of the cylinder block 1 and the upper mounting flange 6*b* of the hydraulic pump 3. As will be seen from FIG. 6, another shock absorbing sheet 31 is disposed between the other mounting portion 5 of the cylinder block 1 and the upper mounting flange 10*a* of the hydraulic motor 9. Due to provision of such shock absorbing sheets 31, the transmission of vibration from the cylinder block 1 to both the hydraulic pump 3 and the hydraulic motor 9 is limited, which increases the durability of these devices 3 and 9.

Figure 8:
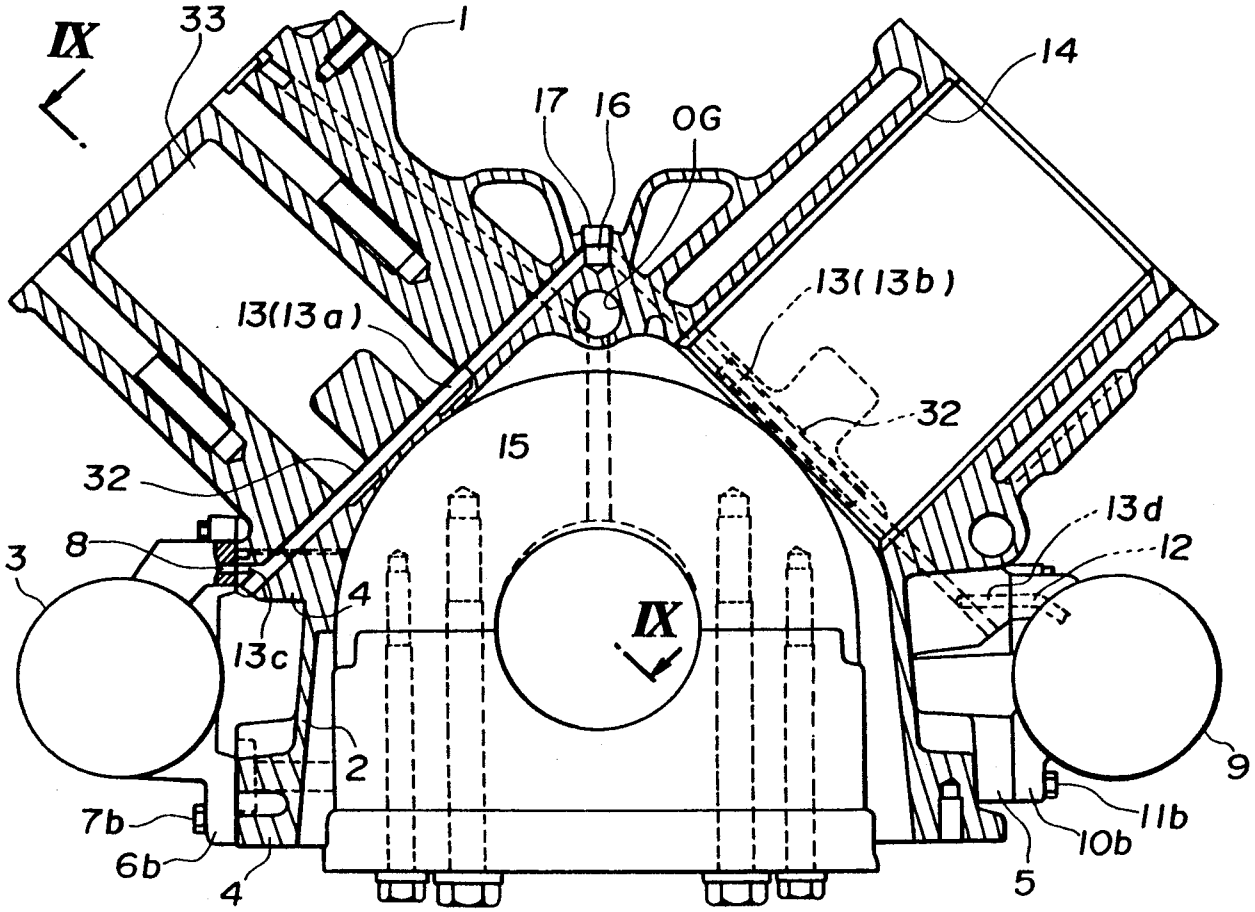
FIG. 8 is a view similar to FIG. 1, but showing a third embodiment.
Figure 9:
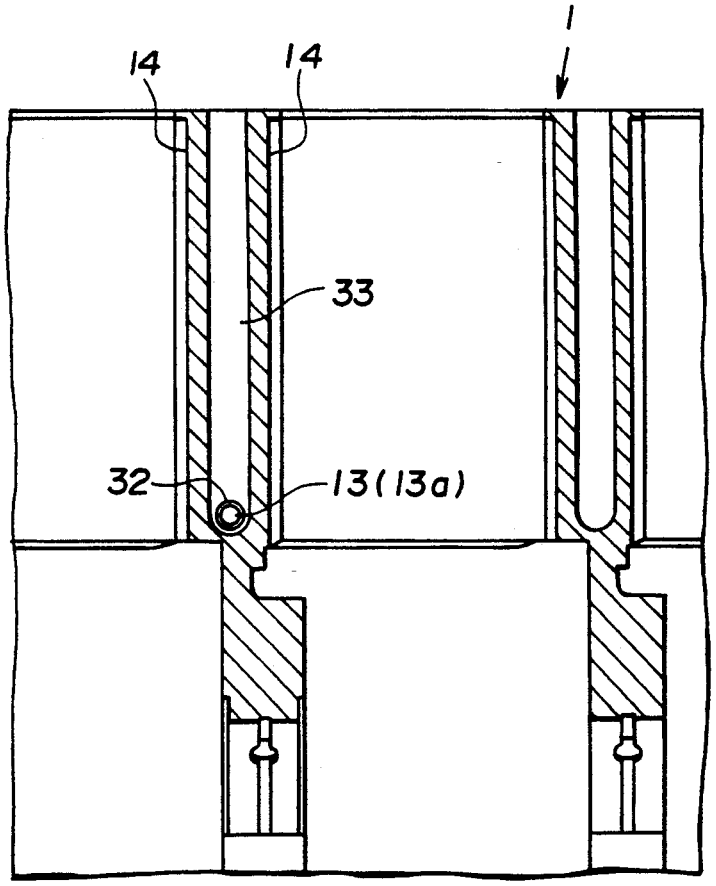
FIG. 9 is a sectional view taken along the line IX—IX of FIG. 8.

Referring to FIGS. 8 and 9, there is shown a third embodiment of the present invention.

As is best seen from FIG. 9, in this third embodiment, a metal tube 32 is tightly disposed in a center zone of the elongate bore 13*a* which extends in the lower deck 15 of the bank. As will be seen from FIG. 8, another metal tube 32 is tightly disposed in the elongate bore 13*b* of the other bank. As is seen from FIG. 9, the metal tube 32 is partially exposed to a water jacket 33 formed between the adjacent cylinder bores. Press-fitting method and monobloc casting method may be used for setting the metal tubes 32 in the cylinder block 1. Because the metal tubes 32 are exposed to the water jacket 33, the oil flowing in the oil flow passage 13 is cooled, which can induce removal of an oil cooler associated with the oil flow passage 13.

Referring to 10 to 12, there is shown a fourth embodiment of the present invention. As will become apparent as the description proceeds, in this fourth embodiment, a so-called "pulsation damping chamber" is provided in the cylinder block 1 to improve the quality of the pressurized oil fed to the hydraulic motor 9.

Figure 10:
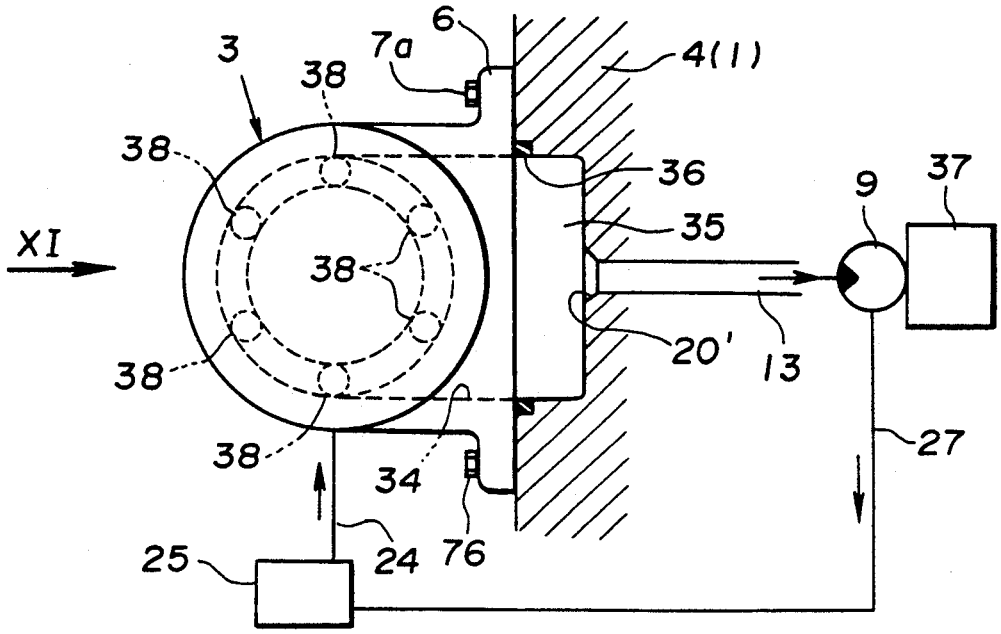
FIG. 10 is a schematic view of an engine accessory driving system of a fourth embodiment of the present invention.

In FIG. 10, the outline of the fourth embodiment is shown. Like the case of the aforementioned first embodiment, the hydraulic pump 3 is bolted at its mounting flanges 6*a* and 6*b* to the mounting portion 4 of the cylinder block 1 through a seal ring 36.

The hydraulic pump 3 used in this fourth embodiment has an enlarged outlet port 34. The oil flow passage 13 formed in the cylinder block 1 has an enlarged mouth portion 35 (viz., pulsation damping chamber) which is connected with the outlet port 34 of the hydraulic pump 3. The pulsation damping chamber 35 has a given volume sufficient for effectively damping the pulsation of the pressurized oil pumped out from the hydraulic pump 3. The oil flow passage 13 has a tapered end 20' exposed to the pulsation damping chamber 35. Designated by numeral 37 is the engine accessory driven by the hydraulic motor 9, and denoted by numeral 38 are check valves possessed by the hydraulic pump 3 as will become apparent hereinafter.

Figure 11:
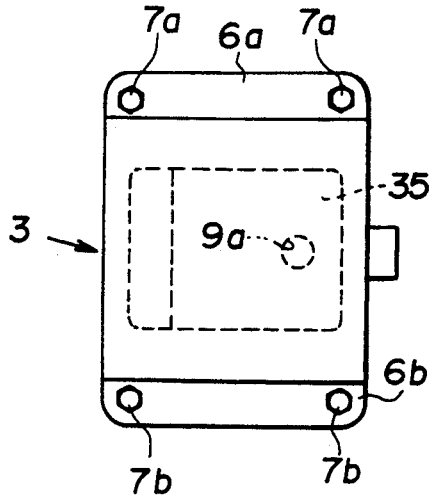
FIG. 11 is a view taken from the direction of the arrow "XI" of FIG. 10.

As will be understood from FIG. 11, the outlet port 34 of the hydraulic pump is rectangular in shape, and the pulsation damping chamber 35 of the cylinder block 1 is also rectangular in shape, but remarkably larger than the outlet port 34.

Figure 12:
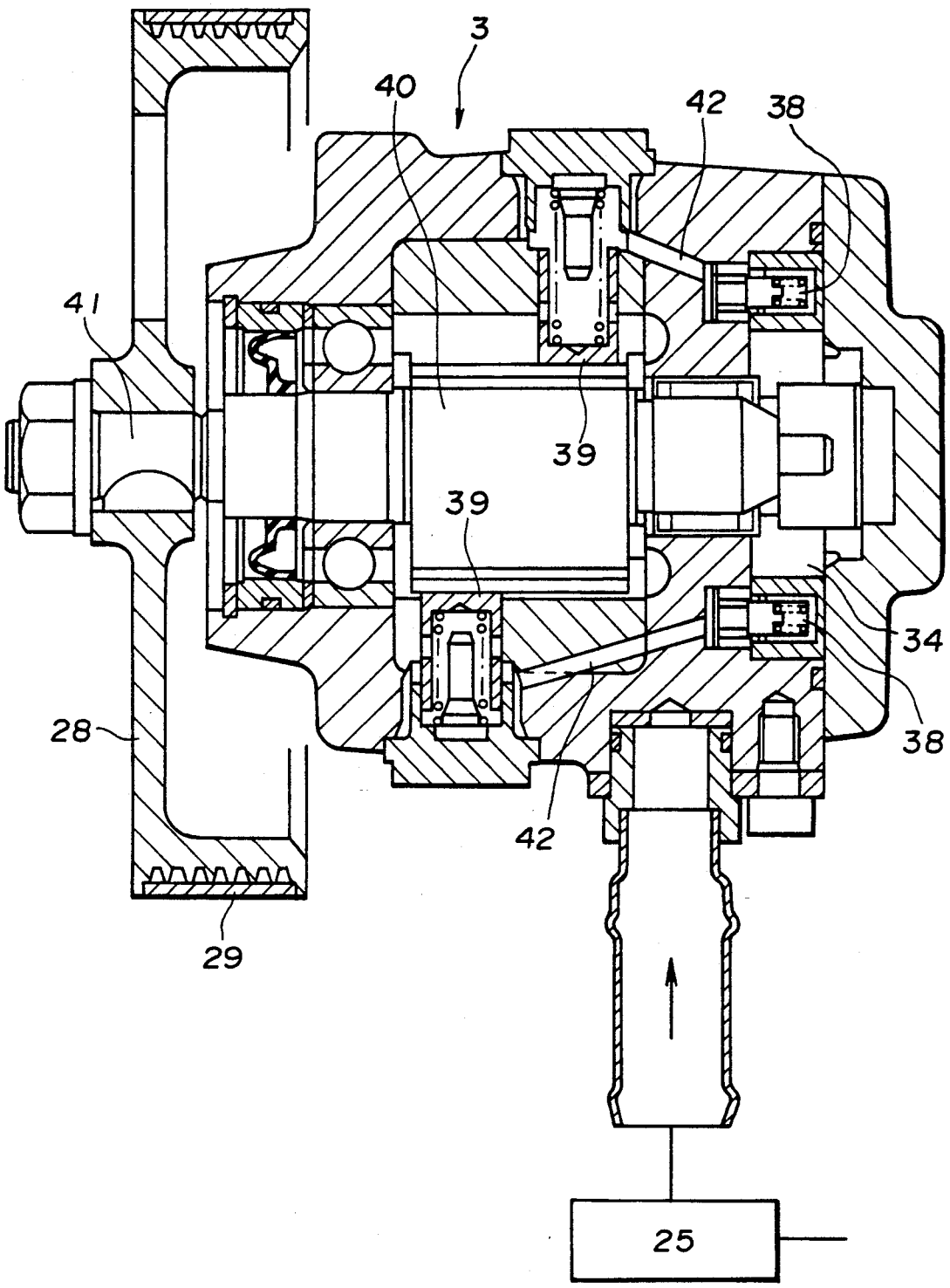
FIG. 12 is a sectional view of a hydraulic pump employable in the present invention.
Figure 13:
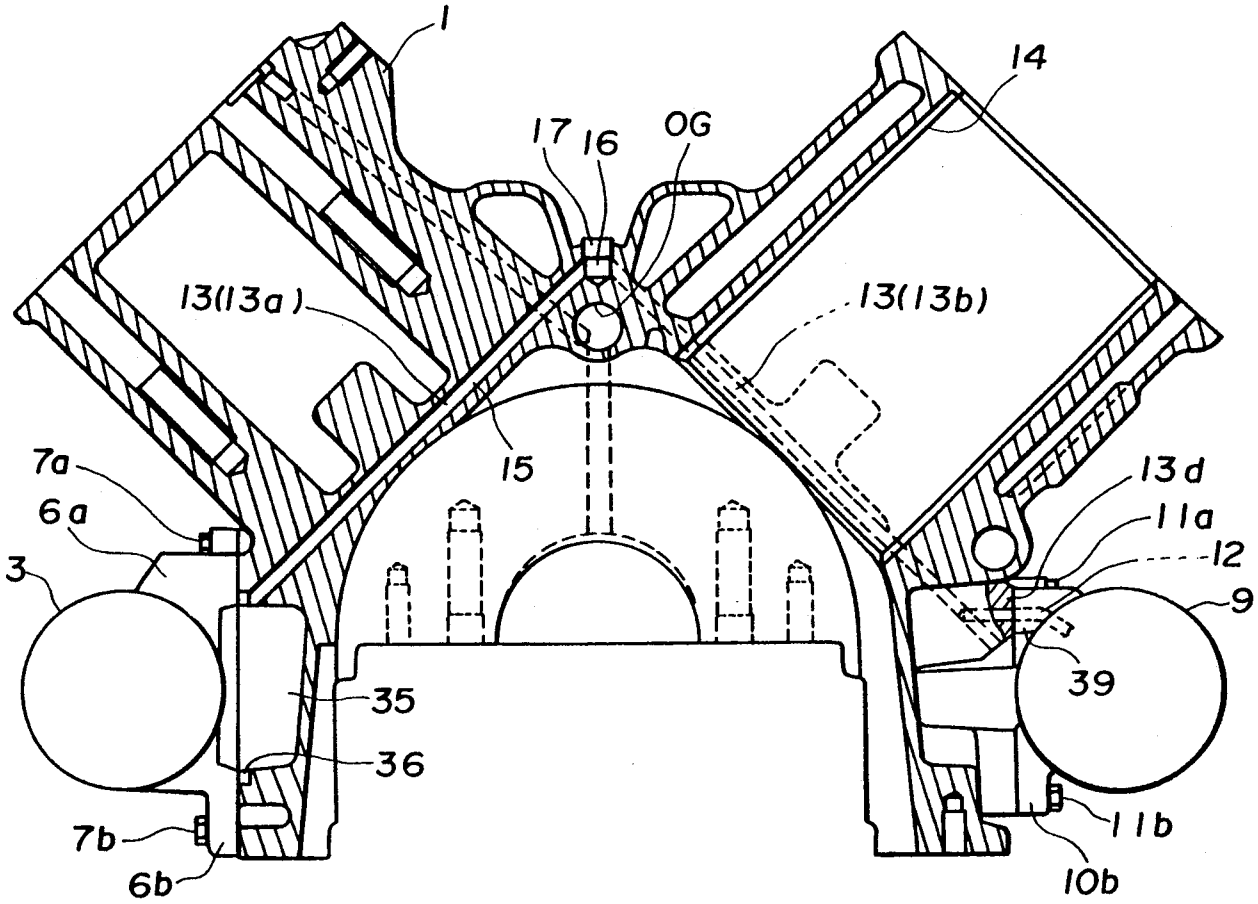
FIG. 13 is a view similar to FIG. 1, but showing a fifth embodiment.

Referring to FIG. 12, there is shown in detail the hydraulic pump 3 which is the radial type. The pump 3 comprises six plungers 39 which are radially arranged at equally angled intervals. The plungers 37 are driven in sequence by a cam 40 provided on a drive shaft 41. The drive shaft 41 has the pulley 28 bolted thereto. The pulley 28 is driven by the engine crankshaft through the transmission belt 29. The oil pressurized by each plunger 39 is drawn into the enlarged outlet port 34 through the corresponding passage 42 and check valve 38. The enlarged outlet port 34 has an annular upstream part which is surrounded by the six check valves 38.

When, in operation, the engine runs, a highly pressurized oil produced by the hydraulic pump 3 stays in the pulsation damping chamber 35 before being fed to the elongate oil flow passage 13. Thus, undesired pulsation of the oil is damped. Because the chamber 35 is formed in the cylinder block 1 which is strongly built, the pulsation of the oil does not induce noisy vibration of the cylinder block 1. If a separate accumulator is employed as a substitute for the chamber 35, the engine accessory driving system becomes complicated in construction.

Referring to FIG. 5, there is shown a fifth embodiment of the present invention. In this embodiment, the concept of the fourth embodiment is practically applied to the V-8 internal combustion engine.

As is shown in this drawing, in this fifth embodiment, the oil flow passage 13 is exposed to an upper end of the pulsation damping chamber 35.

Referring to FIGS. 14 to 20, there is shown a sixth embodiment of the present invention. As will become apparent as the description proceeds, in this sixth embodiment, two hydraulic motors are employed, which are driven by a common hydraulic pump, and an oil tank of the engine accessory driving system is defined by the cylinder block.

Figure 14:
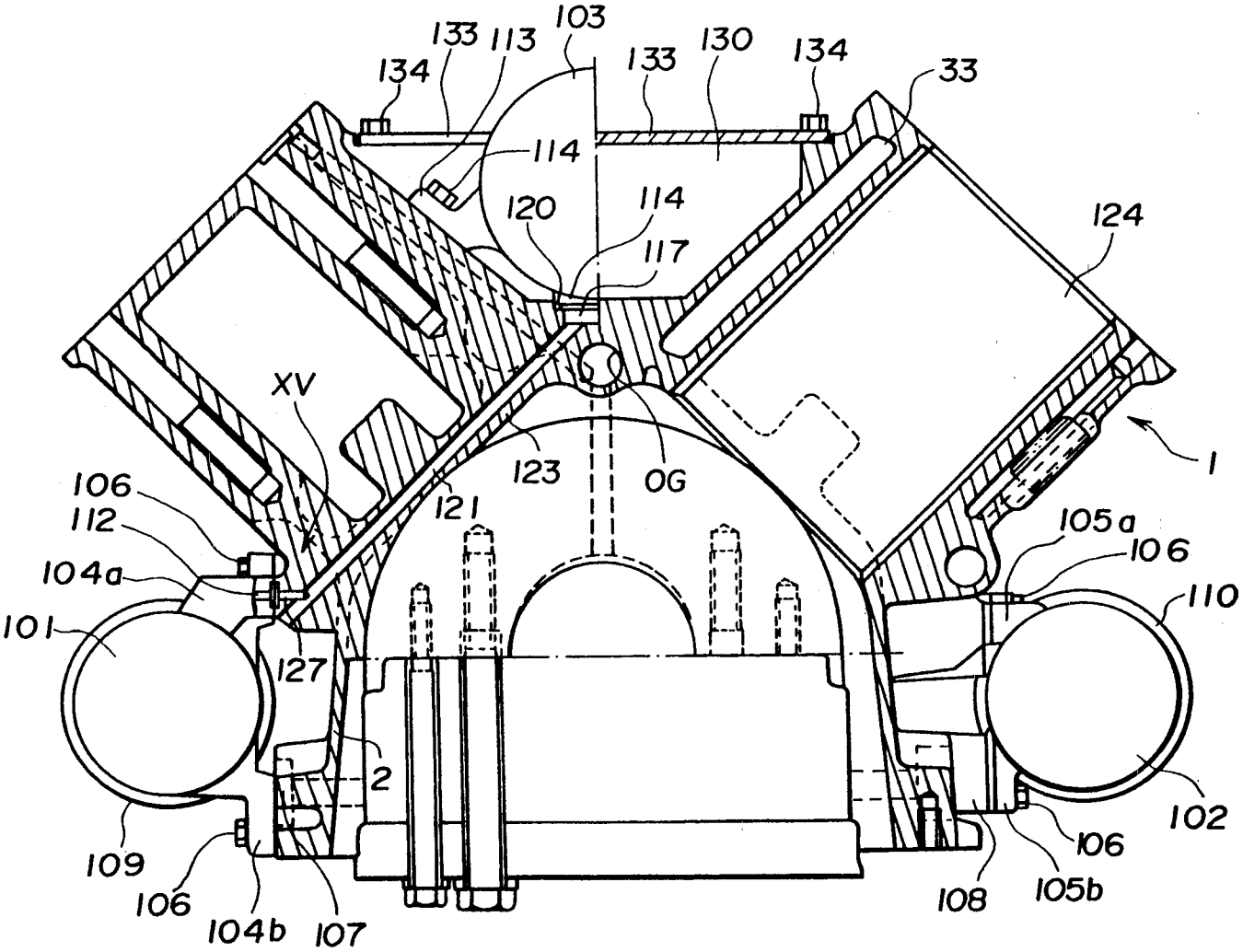
FIG. 14 is a view similar to FIG. 1, but showing a sixth embodiment of the present invention.

As is seen from FIG. 14, first and second hydraulic motors 101 and 102 are mounted on the opposed skirt parts 2 of the cylinder block 1, and a hydraulic pump 103 is mounted on a bottom of a V-shaped recess which is defined by and between the two banks of the cylinder block 1. The first and second hydraulic motors 101 and 102 are each formed with upper and lower mounting flanges 104*a* and 104*b* (or, 105*a* and 105*b*) which are secured through bolts 106 to respective mounting portions 107 and 108 of the cylinder block 1. The first hydraulic motor 101 is arranged to drive a compressor 109 of an aid conditioner, while the second hydraulic motor 102 is arranged to drive an alternator 110.

As is understood from FIG. 14, the upper mounting flange 104*a* or 105*a* of the first or second hydraulic motor 101 or 102 is formed with a through passage 112 (only one is shown) which leads to an inlet port of the hydraulic motor 101 or 102.

The hydraulic pump 103 is cylindrical in shape. The hydraulic pump 103 is formed with two mounting flanges 113 (only one is shown) which are secured through bolts to inside walls of the V-banks of the cylinder block 1.

Figure 16:
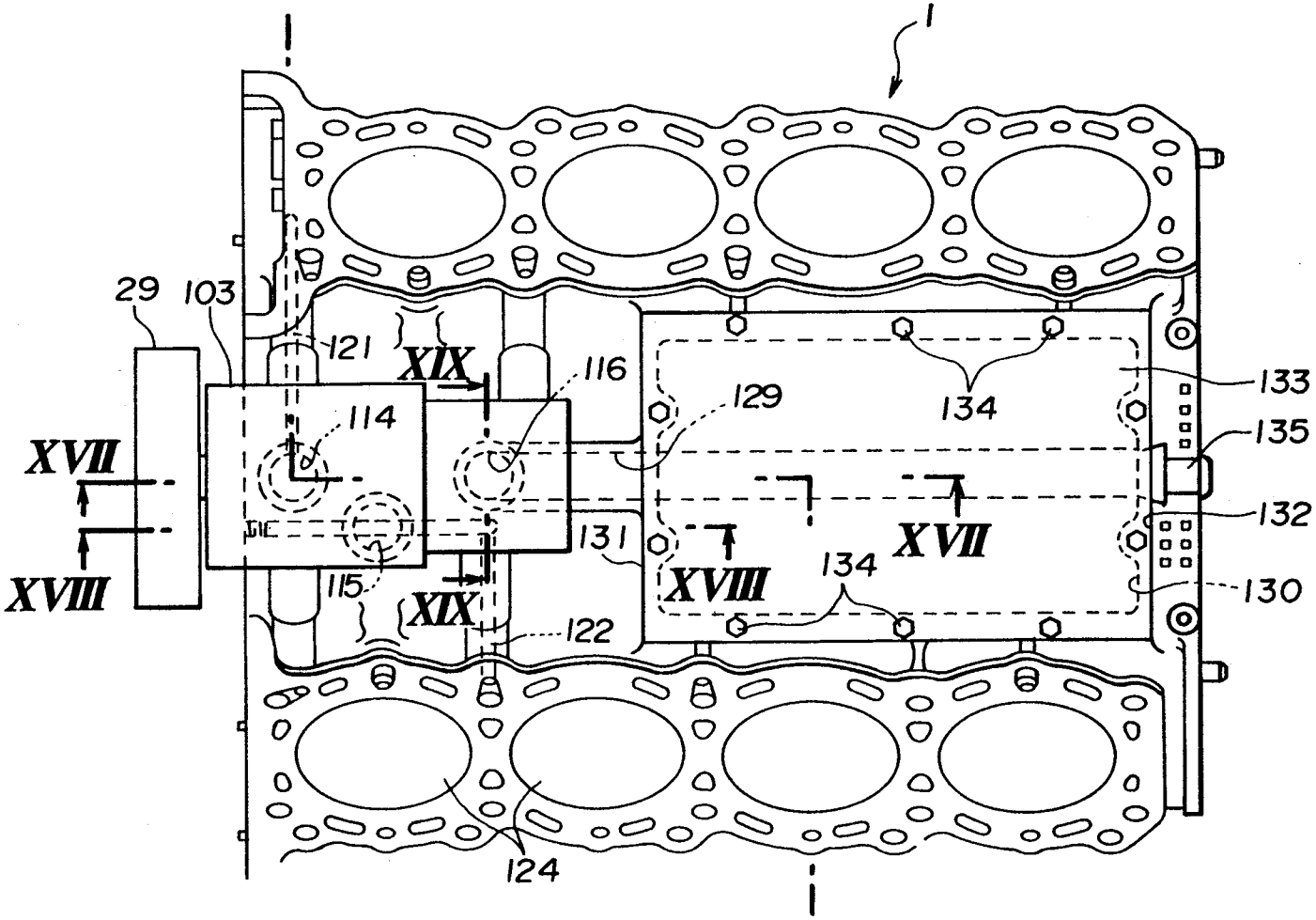
FIG. 16 is a plan view of a cylinder block on which a hydraulic pump is mounted.

As is seen from FIG. 16, the hydraulic pump 103 is mounted on a front end of the cylinder block 1. The pump 103 has a pulley 29 which is driven by the engine crankshaft through a transmission belt (not shown). The hydraulic pump 103 used in this sixth embodiment is of a tandem type which has at its bottom surface two outlet ports 114 and 115 and a single inlet port 116. As is seen from FIGS. 17 and 18, the outlet ports 114 and 115 and the inlet port 116 have cylindrical portions slightly projected outward.

Figure 17:
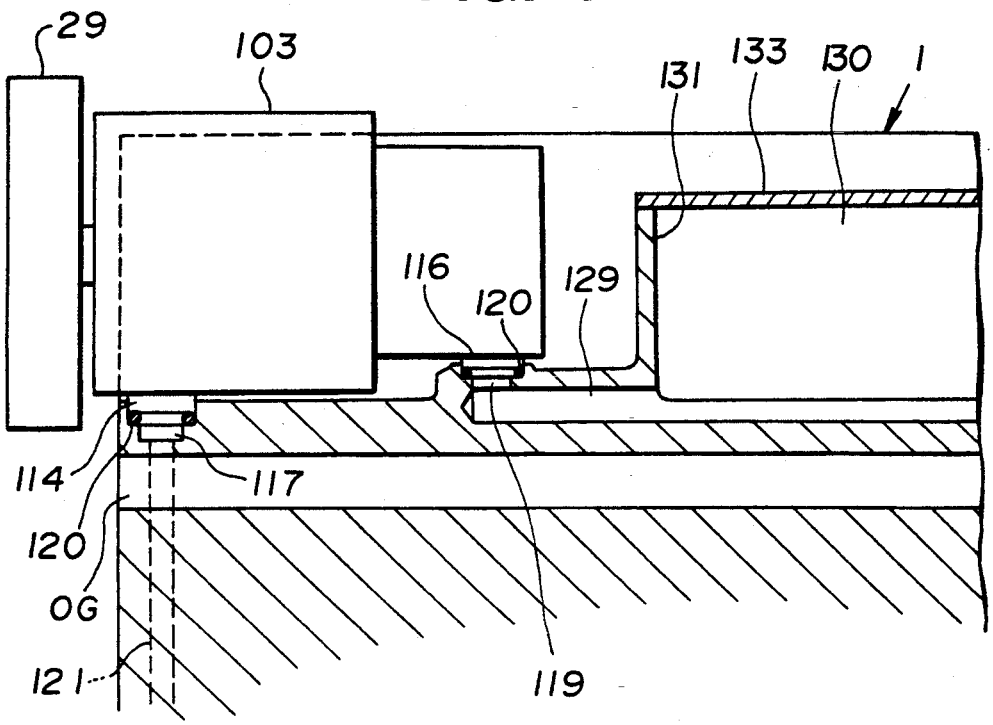
FIG. 17 is an enlarged sectional view taken along the line XVII—XVII of FIG. 16.
Figure 18:
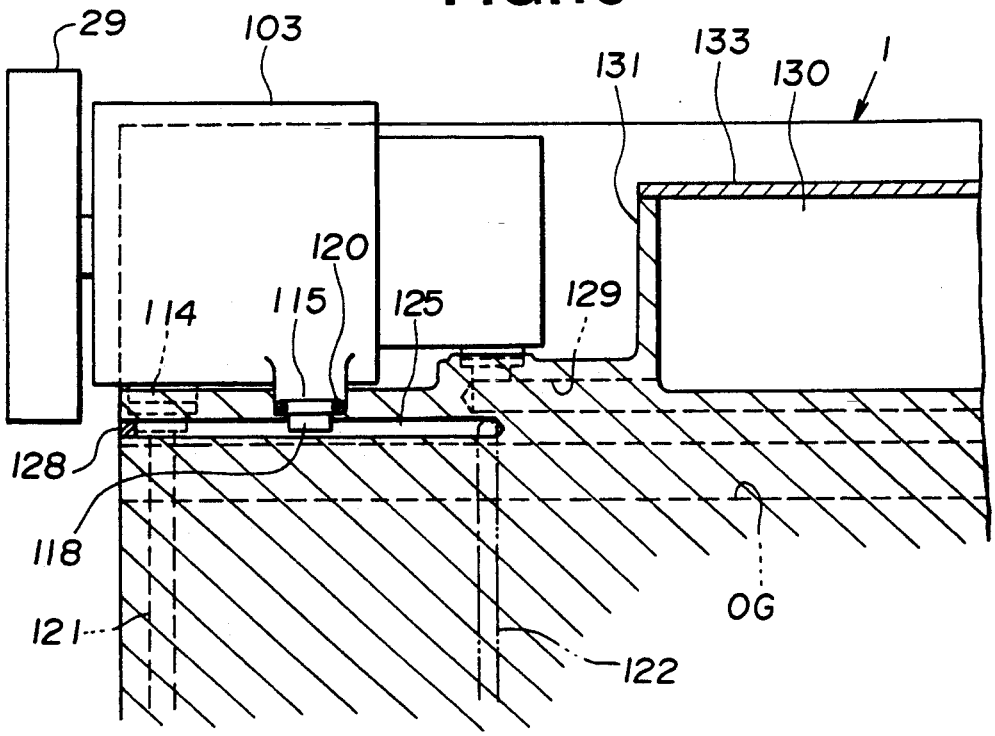
FIG. 18 is an enlarged sectional view taken along the line XVIII—XVIII of FIG. 16.
Figure 19:
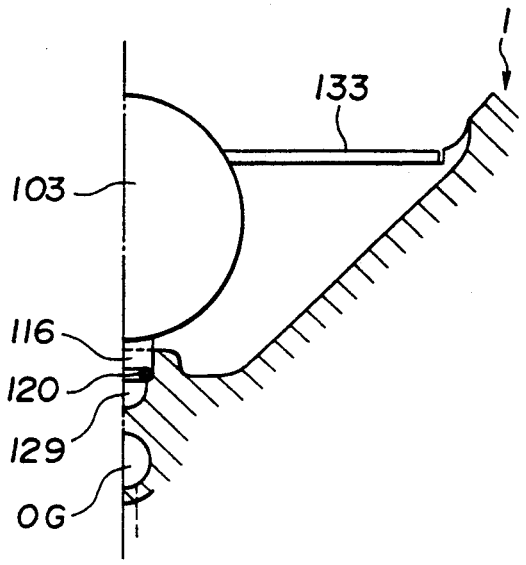
FIG. 19 is an enlarged sectional view taken along the line XIX—XIX of FIG. 16.

As is seen from FIGS. 17 and 18, the projected outlet and inlet portions 114, 115 and 116 of the hydraulic pump 103 are sealingly put in respective recesses 117, 118 and 119 which are formed in the bottom of the V-shaped recess of the cylinder block 1. For achieving the sealing, seal rings 120 are used, as shown.

As is seen from FIGS. 14 and 16, from the recesses 117 and 118, there extend oil flow passages 121 and 122 in the cylinder block 1, which passages lead to the inlet passages 112 of the first and second hydraulic motors 101 and 110 as will be described in detail hereinafter. That is, as is seen from these drawings, the oil flow passage 121 extends straight from the recess 117 through the lower deck 123 near the front end of the corresponding bank (see FIG. 16), while the other oil flow passage 122 extends backward from the recess 118 and extends straight through the lower deck between adjacent two cylinder bores 124. For the backward extension of the oil flow passage 122, a longitudinally extending bore 125 is formed in the bottom of the V-shaped recess of the cylinder block 1 as shown in FIG. 18. An open end of the bore 125 is closed by a sealing plug 128.

Figure 15:
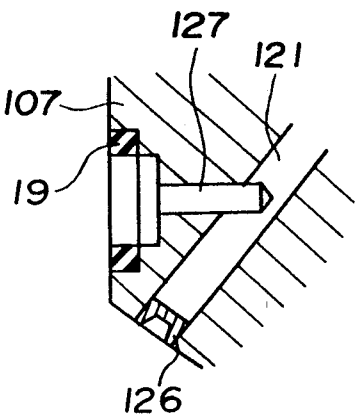
FIG. 15 is an enlarged view of a portion indicated by the arrow "XV" in FIG. 14.

As is seen from FIG. 15, each oil flow passage 121 or 122 has a terminal lower open end which is closed by a sealing plug 126. Like in the case of the aforementioned first embodiment of FIG. 1, each oil flow passage 121 or 122 has near the closed terminal lower end a branch bore 127 which is mated or connected with the inlet passage 112 of the first or second hydraulic motor 101 or 102. The manner for sealingly connecting the branch bore 127 to the corresponding inlet passage 112 is substantially the same as in the case of the connection between the branch bore 13*c* and the outlet passage 8 of the afore-mentioned first embodiment of FIG. 4.

As is seen from FIGS. 16 and 17, from the recess 119, there extends rearward an oil flow passage 129 which leads to an oil tank 130 which is defined by the cylinder block 1 and positioned behind the hydraulic pump 103. That is, the oil tank 130 comprises the opposed inclined inner surfaces of the two banks and front and rear walls 131 and 132 raised from the bottom of the V-shaped recess. An upper opening of the oil tank 130 is closed by a rectangular lid 133 secured thereto through bolts 134.

As is seen from FIG. 17, the oil flow passage 129 from the recess 119 extends to the channel-shaped bottom of the oil tank 130. As is seen from FIG. 16, the cylinder block 1 is equipped at its rear end with a connecting pipe 135 to which the oil flow passage 129 leads. To the connecting pipe 135, there are connected through a junction pipe (not shown) return tubes from the first and second hydraulic motors 101 and 102.

Figure 20:
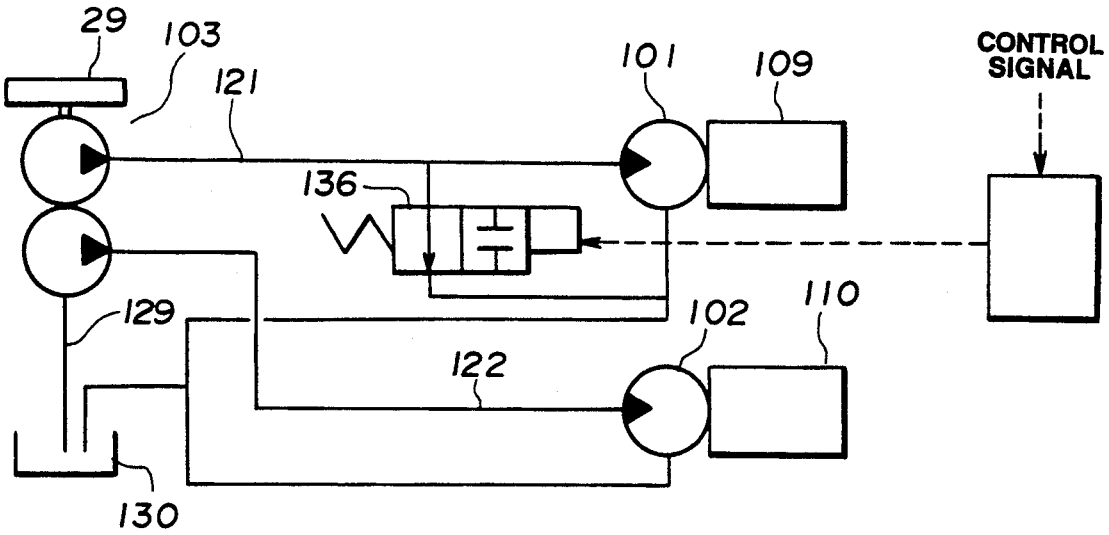
FIG. 20 is a schematic illustration of the engine accessory driving system of the sixth embodiment.

FIG. 20 shows schematically the above-mentioned sixth embodiment. Designated by numeral 136 is a switch valve which is arranged in the hydraulic line of the first hydraulic motor 101. The switch valve 136 is controlled by a control unit 137 to which information signals are fed from the air conditioner. The switch valve 136 is installed in a casing of the hydraulic motor 101.

When, in operation, the engine runs, the hydraulic pump 103 is driven. Thus, pumping up the oil from the oil tank 130 through the oil flow passage 129, the hydraulic pump 103 feeds the first and second hydraulic motors 101 and 102 with highly pressurized oil to operate the same through the respective oil flow passages 121 and 122. The oil exhausted from the pump 103 shows the pressure of about 100 to 200 $Kg/cm^2$. Thus, the compressor 109 and alternator 110 powered by these motors 101 and 102 can work powerfully. The oil from the hydraulic motors 101 and 102 is returned to the oil tank 130 through the return tubes.

In the following, advantages of the sixth embodiment will be described.

First, like in the first to fifth embodiments, the passages for conveying the highly pressurized oil from the hydraulic pump 103 to the hydraulic motors 101 and 102 are formed in the cylinder block 1 which is strongly built. Thus, noise trouble, oil leakage and troublesome assembly are eliminated or at least minimized.

Second, since the hydraulic pump 103 and the oil tank 130 are neatly disposed in the V-channel space defined by the two banks of the cylinder block 1, the entire of the engine system can be made compact in size.

Third, since the oil tank 130 is integrally formed by the cylinder block 1, the temperature control of the oil for the engine accessory driving system is suitably achieved. That is, upon starting of the engine, the temperature of the oil can be quickly increased. Furthermore, even when the operation load of the accessories is high, excessive increase of the oil temperature is suppressed.

Figure 21:
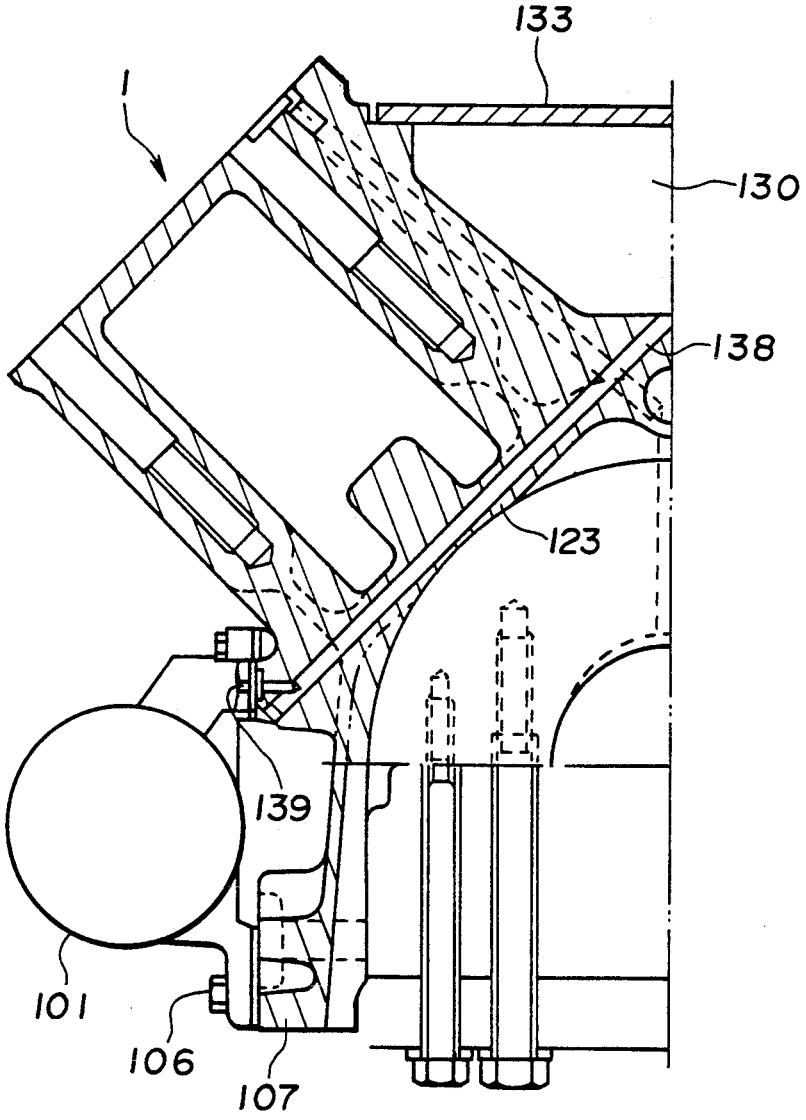
FIG. 21 is a sectional half view of a cylinder block of V-8 engine, but showing a seventh embodiment of the present invention.

Referring to FIG. 21, there is shown a seventh embodiment of the present invention.

In this embodiment, the return passages 138 which connect outlet ports 139 of the hydraulic motors 101 and 102 with the oil tank 130 are also formed in the cylinder block 1. Of course, in this case, a separate means which corresponds to the connecting pipe 135 of the sixth embodiment of FIG. 16 is not necessary.

Figure 22:
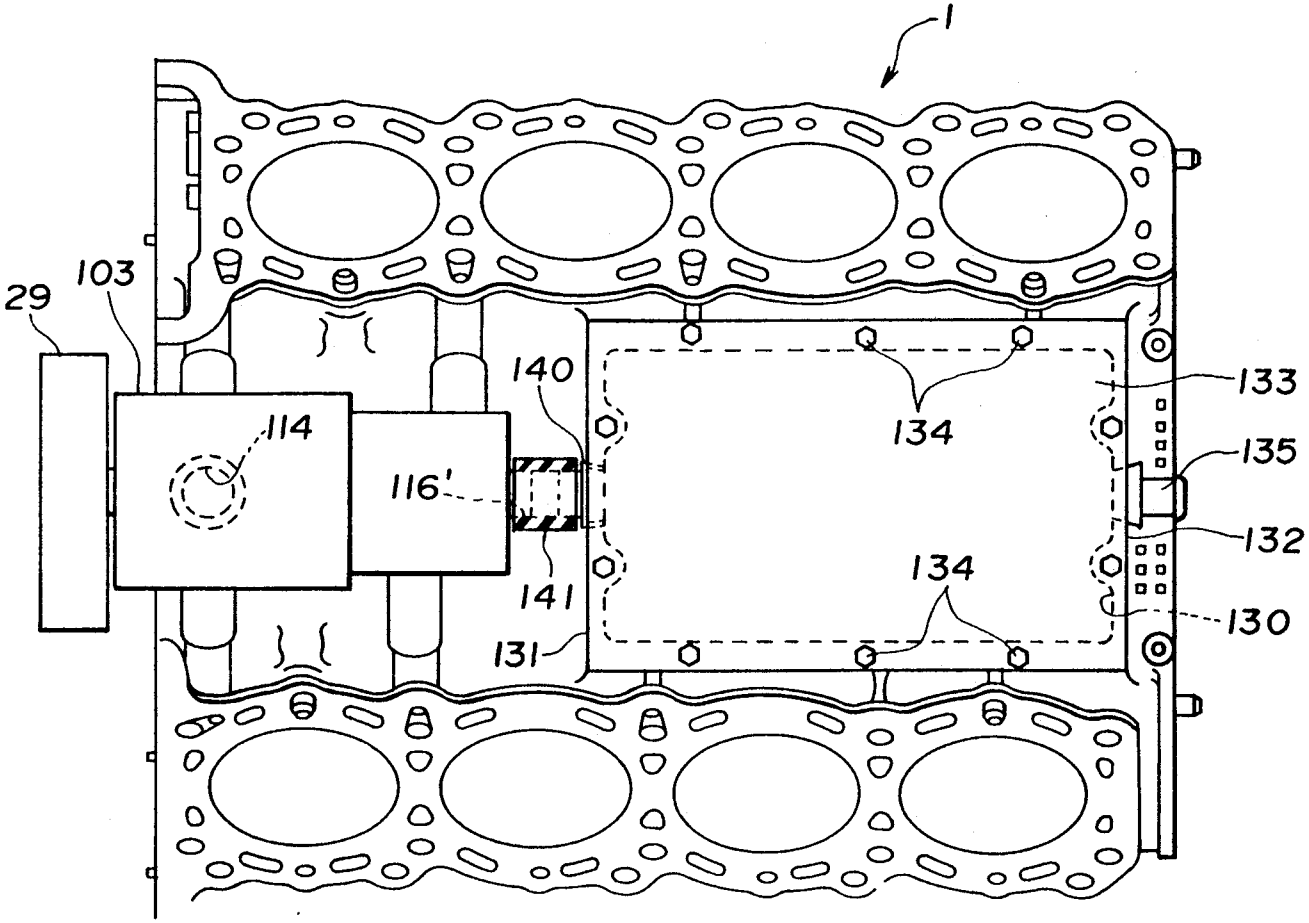
FIG. 22 is a view similar to FIG. 16, but showing an eighth embodiment of the present invention.

Referring to FIG. 22, there is shown an eighth embodiment of the invention.

In this embodiment, the inlet port 116' of the hydraulic pump 103 is positioned to face the front wall 131 of the oil tank 130, and the front wall 131 is formed with an outlet port 140. These two ports 116' and 140 are connected through a tube 141. According to this arrangement, replacement of the hydraulic pump 103 is easily achieved.

Although the foregoing description is directed to V-8 type internal combustion engines, the present invention is applicable to other types of internal combustion egnines, such as engines having an in-line cylinder block, engines having an opposed cylinder block and the like.

What is claimed is:

1. An engine accessory driving system for use with an internal combustion engine having a cylinder block, comprising:

a hydraulic pump mounted to said cylinder block and powered by said engine;

a hydraulic motor mounted to said cylinder block and driven by a highly pressurized oil fed by said hydraulic pump;

means defining in said cylinder block an oil flow passage through which said highly pressurized oil is conveyed from said hydraulic pump to said hydraulic motor; and oil returning means for returning the oil from said hydraulic motor to said hydraulic pump.

2. An engine accessory driving system as claimed in claim 1, in which said oil flow passage is defined between adjacent cylinder bores of said cylinder block.

3. An engine accessory driving system as claimed in claim 2, in which said oil flow passage is defined in a lower deck of said cylinder block.

4. An engine accessory driving system as claimed in claim 1, in which a part of said oil flow passage is constructed of a metal tube which is exposed to a water jacket defined in said cylinder block.

5. An engine accessory driving system as claimed in claim 1, in which said hydraulic pump has an outlet port which is connected through a coupling sleeve to an inlet part of said oil flow passage of said cylinder block.

6. An engine accessory driving system as claimed in claim 5, in which said coupling sleeve has opposed end portions which are tightly and respectively received in said outlet port and said inlet port.

7. An engine accessory driving system as claimed in claim 6, in which said cylinder block is formed with a leak passage through which the oil leaked from said coupling sleeve is led to a crankcase of the engine.

8. An engine accessory driving system as claimed in claim 7, further comprising:

a first seal ring operatively disposed about said coupling sleeve to achieve isolation between said oil flow passage and said leak passage; and a second seal ring interposed between mutually mating portions of said hydraulic pump and said cylinder block to prevent leakage of oil from the oil flow passage to the outside of the cylinder block.

9. An engine accessory driving system as claimed in claim 1, in which said oil flow passage is formed with an enlarged bore part which serves as a pulsation damping chamber.

10. An engine accessory driving system as claimed in claim 9, in which said enlarged bore is defined in said cylinder block at the position which faces an outlet port of said hydraulic pump.

11. An engine accessory driving system as claimed in claim 1, in which said oil returning means comprises:

a return tube extending from an outlet port of said hydraulic motor to an inlet port of said hydraulic pump; and an oil tank disposed in said return tube.

12. An engine accessory driving system as claimed in claim 1, in which said oil returning means comprises:

means defining in said cylinder block another oil flow passage through which the oil is conveyed from an outlet port of said hydraulic pump to an inlet port of said hydraulic pump; and means defining in said cylinder block a recess which is sized to serve as an oil tank, said recess having a portion merged with said another oil flow passage.

13. An engine accessory driving system for use with an internal combustion engine having a V-type cylinder block;

a hydraulic pump mounted on a bottom of a V-shaped recess which is defined by and between the two banks of said V-type cylinder block, said hydraulic pump being powered by said engine;

first and second hydraulic motors respectively mounted to the two banks of said cylinder block, each hydraulic motor being driven by a highly pressurized oil fed by said hydraulic pump;

means for defining in said cylinder block respective oil flow passages through which said highly pressurized oil is conveyed from said hydraulic pump to said first and second hydraulic pumps independently; and oil returning means for conveying the oil from said first and second hydraulic motors to said hydraulic pump.

14. An engine accessory driving system as claimed in claim 13, said oil returning means comprises:

means defining in said two banks respective oil return passages, each oil return passage extending from an outlet port of the corresponding hydraulic motor to an inlet port of said hydraulic pump; and means defining in the bottom of said V-shaped recess of said cylinder block a recess which is sized to serve as an oil tank, said recess having a portion merged with the oil return passages.

15. An engine accessory driving system as claimed in claim 14, in which each of said oil flow passages is defined in a lower deck between adjacent cylinder bores of the corresponding bank.

16. An engine accessory driving system as claimed in claim 14, further comprising a separate tube which connects an outlet port of said oil tank with said inlet port of said hydraulic pump.

* * * * *